US009759517B2

(12) United States Patent
Toeckes et al.

(10) Patent No.: US 9,759,517 B2
(45) Date of Patent: Sep. 12, 2017

(54) APPARATUS AND METHOD FOR DISPENSING INCENDIARY SPHERES

(71) Applicant: DONMARK HOLDINGS INC., Delta (CA)

(72) Inventors: Mark Toeckes, Delta (CA); Robert Button, Vancouver (CA); Earl Trautman, Delta (CA)

(73) Assignee: DONMARK HOLDING INC., Delta (CA)

( * ) Notice: Subject to any disclaimer, the term of this patent is extended or adjusted under 35 U.S.C. 154(b) by 0 days.

(21) Appl. No.: 15/192,778

(22) Filed: Jun. 24, 2016

(65) Prior Publication Data

US 2016/0377376 A1 Dec. 29, 2016

Related U.S. Application Data

(60) Provisional application No. 62/184,771, filed on Jun. 25, 2015.

(51) Int. Cl.
*B64D 1/04* (2006.01)
*F41F 5/00* (2006.01)
*F42B 12/44* (2006.01)

(52) U.S. Cl.
CPC ..... *F41F 5/00* (2013.01); *F42B 12/44* (2013.01)

(58) Field of Classification Search
CPC ..... F41F 5/00; F42B 12/44
See application file for complete search history.

(56) References Cited

U.S. PATENT DOCUMENTS 2,631,769 A * 3/1953 Everett ..... B67C 3/246 141/138
5,062,543 A * 11/1991 Germain ..... A01K 5/0275 221/197
5,282,454 A * 2/1994 Bell ..... F41A 9/48 124/49
5,816,232 A * 10/1998 Bell ..... F41B 11/53 124/48

(Continued)

*Primary Examiner* — Samir Abdosh

(57) ABSTRACT

An apparatus for dispensing incendiary spheres comprising a hopper operable to store discrete unitary unprimed spheres; a feed mechanism cooperating with the hopper to extract unprimed spheres from the hopper; a rotary sphere delivery mechanism rotating in a first direction and having at least one pocket defined therein, the at least one pocket being adapted to capture a sphere, wherein the feed mechanism cooperates with the rotary sphere delivery mechanism to load an unprimed sphere into the at least one pocket; a rotary injector mechanism rotating in an opposing second direction and having at least one injector needle, wherein the rotary injector mechanism and the rotary sphere delivery mechanism are synchronized such that the at least one injector needle pierces an unprimed sphere within the at least one pocket as the at least one pocket and the at least one injector needle rotate past each other; a source of reactant in fluid communication with the at least one injector needle, wherein the rotary injector mechanism delivers an amount of reactant to the at least one injector upon the at least one injector piercing the sphere to start a delayed exothermic reaction within the sphere thereby priming the sphere; and a motor to drive the rotary sphere delivery mechanism and the rotary injector mechanism.

11 Claims, 6 Drawing Sheets

(56) References Cited

U.S. PATENT DOCUMENTS

| | | | | |
|---|---|---|---|---|
| 6,952,169 | B1 * | 10/2005 | Simtion | A62C 37/44 169/60 |
| 7,275,529 | B2 * | 10/2007 | Boys | F42B 12/44 124/66 |
| 7,451,679 | B2 * | 11/2008 | Stevenson | A62C 3/0285 102/336 |
| 8,316,750 | B2 * | 11/2012 | Toeckes | A62C 3/025 124/71 |
| 8,776,693 | B2 * | 7/2014 | Toeckes | A62C 3/08 102/364 |
| 2006/0027380 | A1 * | 2/2006 | Stevenson | A62C 3/0285 169/45 |

* cited by examiner

APPARATUS AND METHOD FOR DISPENSING INCENDIARY SPHERES

BACKGROUND OF THE INVENTION

1. Field of Invention

This invention relates to intentional burning for land and forestry management and, in particular, to an aerial apparatus, method and system for dispensing incendiary spheres.

2. Description of Related Art

Prescribed burning is the intentional burning of typically forested areas or grasslands to meet specific land management objectives, such as to reduce flammable fuels, restore ecosystem health, recycle nutrients, or prepare an area for new trees or vegetation.

Some prior art devices for igniting prescribed fires include aerial ignition devices that are typically mounted within the cargo area of a helicopter and receive plastic spheres containing an incendiary material, such as potassium permanganate. The devices inject the received unprimed spheres with a reactant, such as ethylene glycol, to prime the incendiary spheres, and then expel the injected or primed incendiary spheres to fall from the helicopter. A delayed exothermic reaction between the incendiary material and the reactant within the spheres can produce a prescribed fire where the spheres land. The delay of the exothermic reaction is typically 25 to 30 seconds. An example of such prior art device is described in U.S. Pat. No. 8,776,693 that is incorporated herein by reference. Another prior art aerial ignition device dispenses incendiary capsules obtained from capsule belts stored in magazines, which also typically rely on an injection mechanism to inject reactant into the unprimed capsules. The aforementioned devices rely on a reciprocating injection mechanism on which a needle reciprocates in a linear manner. And most conventional aerial ignition devices are designed to be mounted in the helicopter with a chute extending to the outside and below the fuselage of the helicopter for dropping primed incendiary spheres or capsules on the ground below.

Mounting aerial ignition devices in the aircraft carries risks of onboard fires or smoke, and often involves obtaining onerous regulatory approval from governmental agencies that have oversight on aviation and aerial operations, for example the Federal Aviation Administration in the U.S. and Transport Canada in Canada. There are some ignition devices that are suspended below the helicopter but these are crude devices that rely on a gelled fuel mixture and an ignition source to drip flaming globules of fuel onto the ground below instead of incendiary spheres or capsules. The disadvantages of the gelled fuel dripping method include the hazards and inconvenience of transporting the fuel to the site, the hazards of hauling the gelled fuel in the air, the aircraft must return frequently to refill the gelled fuel, the method requires a larger and well trained crew, and the method does not lend itself to under-burning operation since the burning fuel globules can ignite tree crowns. Accordingly, there is a need for improved aerial ignition devices and methods.

SUMMARY

The above shortcomings may be addressed by providing, in accordance with one aspect of the invention, an apparatus for dispensing incendiary spheres comprising a hopper operable to store discrete unitary unprimed spheres; a feed mechanism cooperating with the hopper to extract unprimed spheres from the hopper; a rotary sphere delivery mechanism rotating in a first direction and having at least one pocket defined therein, the at least one pocket being adapted to capture a sphere, wherein the feed mechanism cooperates with the rotary sphere delivery mechanism to load an unprimed sphere into the at least one pocket; a rotary injector mechanism rotating in an opposing second direction and having at least one injector needle, wherein the rotary injector mechanism and the rotary sphere delivery mechanism are synchronized such that the at least one injector needle pierces an unprimed sphere within the at least one pocket as the at least one pocket and the at least one injector needle rotate past each other; a source of reactant in fluid communication with the at least one injector needle, wherein the rotary injector mechanism delivers an amount of reactant to the at least one injector upon the at least one injector piercing the sphere to start a delayed exothermic reaction within the sphere thereby priming the sphere; and a motor to drive the rotary sphere delivery mechanism and the rotary injector mechanism.

In some embodiments, the apparatus may further comprise a sphere expulsion mechanism operable to expel the primed sphere from the apparatus so that the primed sphere may fall away from the apparatus.

In some embodiments, the at least one injector needle may be operable to withdraw the primed sphere from the at least one pocket as the at least one pocket and the at least one injector needle rotate away from each other, and the sphere expulsion mechanism may comprise a ramp surface against which the primed sphere abuts after withdrawal from the at least one pocket, the ramp surface being configured to cause a release of the primed sphere from the at least one injector needle.

In some embodiments, the apparatus may further comprise a stripping mechanism cooperating with the rotary sphere delivery mechanism to clear a sphere, or debris in the event of a broken sphere, left in the at least one pocket after the sphere expulsion mechanism.

In some embodiments, the feed mechanism may comprise a rotary feed mechanism defining at least one second pocket adapted to capture a sphere from the hopper, wherein the rotary feed mechanism is synchronized with the rotary sphere delivery mechanism such that the at least one second pocket aligns with the at least one pocket on the rotary sphere delivery mechanism to deliver its sphere to the at least one pocket.

In some embodiments, the motor drives the rotary feed mechanism, and wherein the rotary sphere delivery mechanism and the rotary injector mechanism are directly or indirectly geared to the rotary feed mechanism.

In some embodiments, the apparatus may further comprise a position sensor operable to provide information on the spatial position of any one or more of the at least one pocket, the at least one injector needle, and the at least one second pocket.

In some embodiments, the apparatus may further comprise a controller operable use the spatial position provide by the position sensor to stop the motor just after release of the primed sphere from the at least one pocket but before a next sphere is primed by the at least one injector needle.

In some embodiments, the rotary injector mechanism may include a constant volume pump that is activated upon the at least one injector needle piercing the sphere to deliver a measured volume of reactant to the sphere.

In some embodiments, the apparatus may further comprise a support upon which the other structures are mounted, wherein the support includes suspension members to enable the apparatus to being suspended below an aircraft.

In some embodiments, the apparatus may further comprise a support upon which the other structures are mounted, wherein the support is adapted to being mounted in an aircraft in a manner that the primed spheres fall outside of the aircraft.

The invention also provides a method of starting controlled fires from an aircraft comprising suspending an incendiary dispensing apparatus below the fuselage of the aircraft and causing the apparatus to drop incendiary spheres onto the ground below the aircraft.

Other aspects and features of the present invention will become apparent to those of ordinary skill in the art upon review of the following description of embodiments of the invention in conjunction with the accompanying figures.

BRIEF DESCRIPTION OF THE DRAWINGS

In drawings which illustrate by way of example only embodiments of the invention:

FIGS. 1*a* and 1*b* are perspective views of two variants of an apparatus for dispensing spheres according to the present invention in which FIG. 1*a* shows an embodiment for being suspended below an aircraft, and FIG. 1*b* shows an embodiment for mounting in the aircraft;

DETAILED DESCRIPTION

Figure 1A:
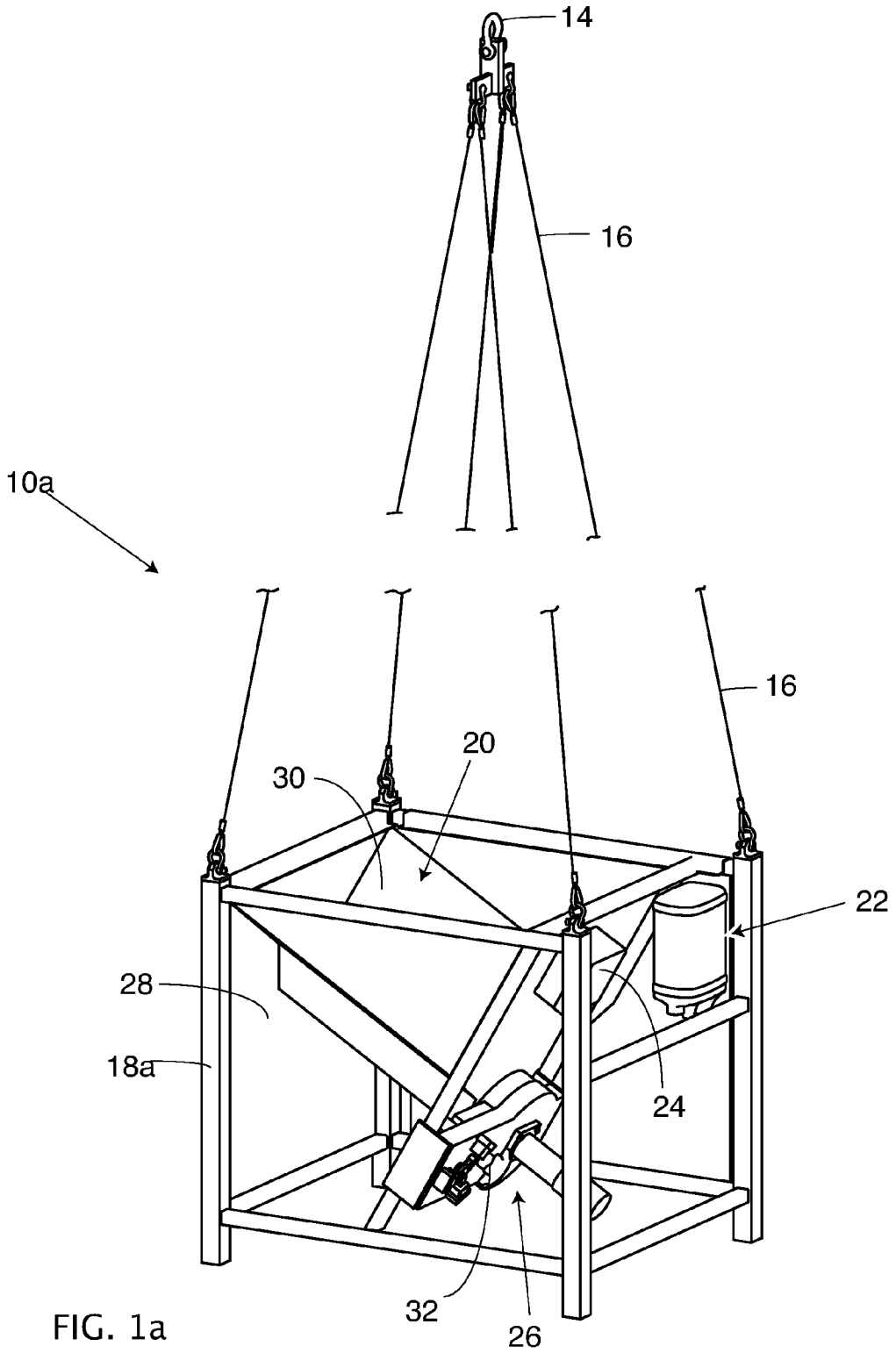
Figure 1B:
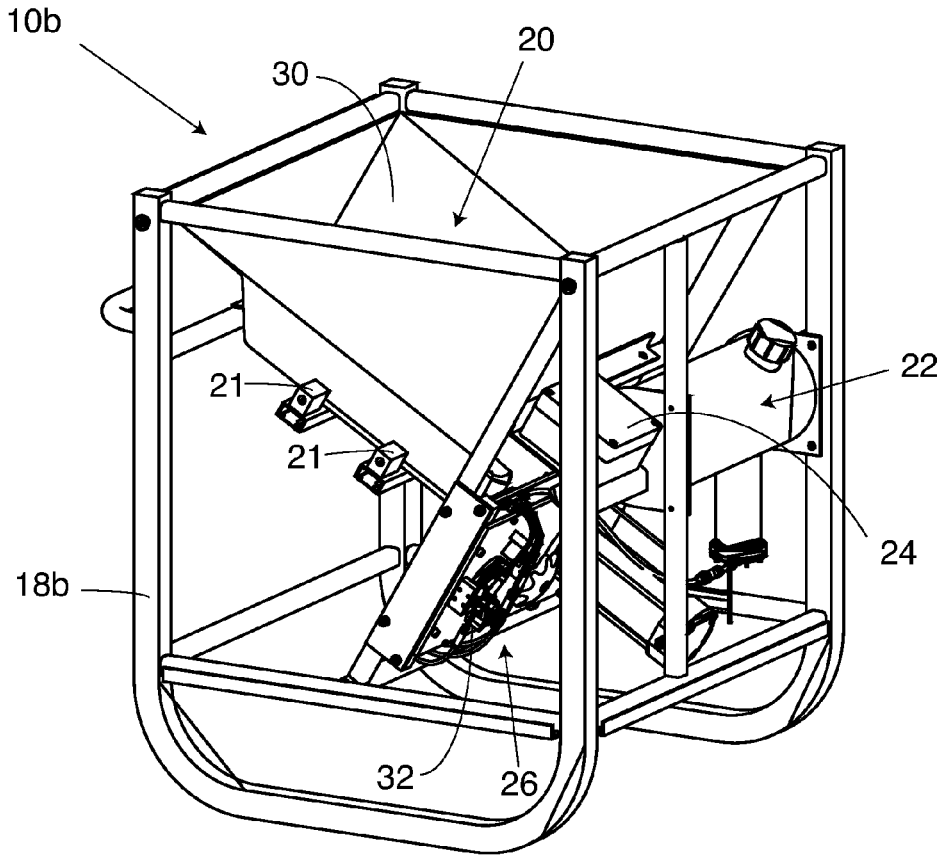

Referring to FIGS. 1*a* and 1*b,* an apparatus for dispensing incendiary spheres according to some embodiments of the invention are shown generally at 10*a* in FIG. 1*a* and 10*b* in FIG. 1*b*.

The apparatus 10*a* includes suspension members, such as a suspension head 14 and suspension lines 16 to enable the device to being suspended below a helicopter from its cargo hook, a support such as frame 18*a,* a storage device for unprimed incendiary spheres 20, a reactant reservoir 22, a controller 24, a priming and release mechanism 26, and a remote control (not shown).

The suspension head 14 is configured to attach to a cargo hook of a helicopter or other suitable aircraft, and it includes connection points for the top ends of suspension lines 16. The bottom ends of the suspension lines 16 each connect to a point on the frame 18*a* in a manner that the load born by the frame is appropriately distributed and the priming and release mechanism 26 is held in a desired orientation for dispensing the primed incendiary spheres or capsules.

The frame 18*a* is configured to support the storage device for unprimed incendiary spheres or capsules 20, the reactant reservoir 22 (for example ethylene glycol), the controller 24 and the priming and release mechanism 26 in relative positions to each other so as to enable them to cooperate to prime and release incendiary spheres as required by the operator. The frame may include enclosure panels 28 to enclose some or all of the aforementioned mechanisms. In FIG. 1*a*, the forward enclosure panels have been removed for clarity.

Referring specifically to the illustrated embodiment, the storage device for unprimed incendiary spheres or capsules 20 comprises a sphere hopper 30 for storing unprimed incendiary spheres and delivering them to the priming and release mechanism 26. The reactant reservoir 22 holds glycol. And the priming and release mechanism 26 comprises an injection head 32.

The apparatus 10*b* includes the same structures as apparatus 10*a* except that it omits the suspension members, and the frame 18*a* is adapted to being carried or mounted in an aircraft in a manner similar to the device described in U.S. Pat. No. 8,776,693.

Figure 2:
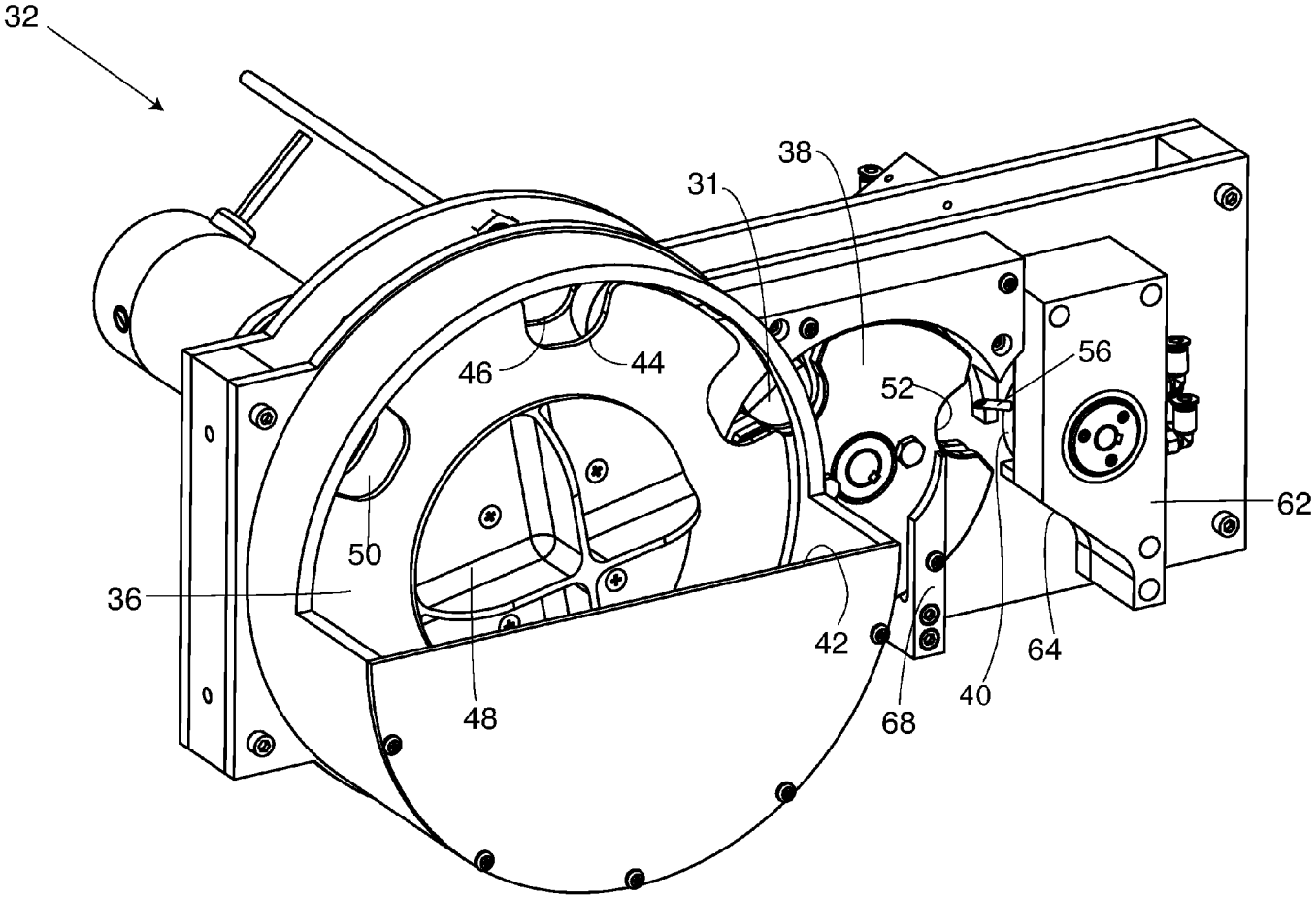
FIG. 2 is a perspective view from the front of an injection head of the apparatus of FIG. 1*a* or 1*b;*
Figure 3:
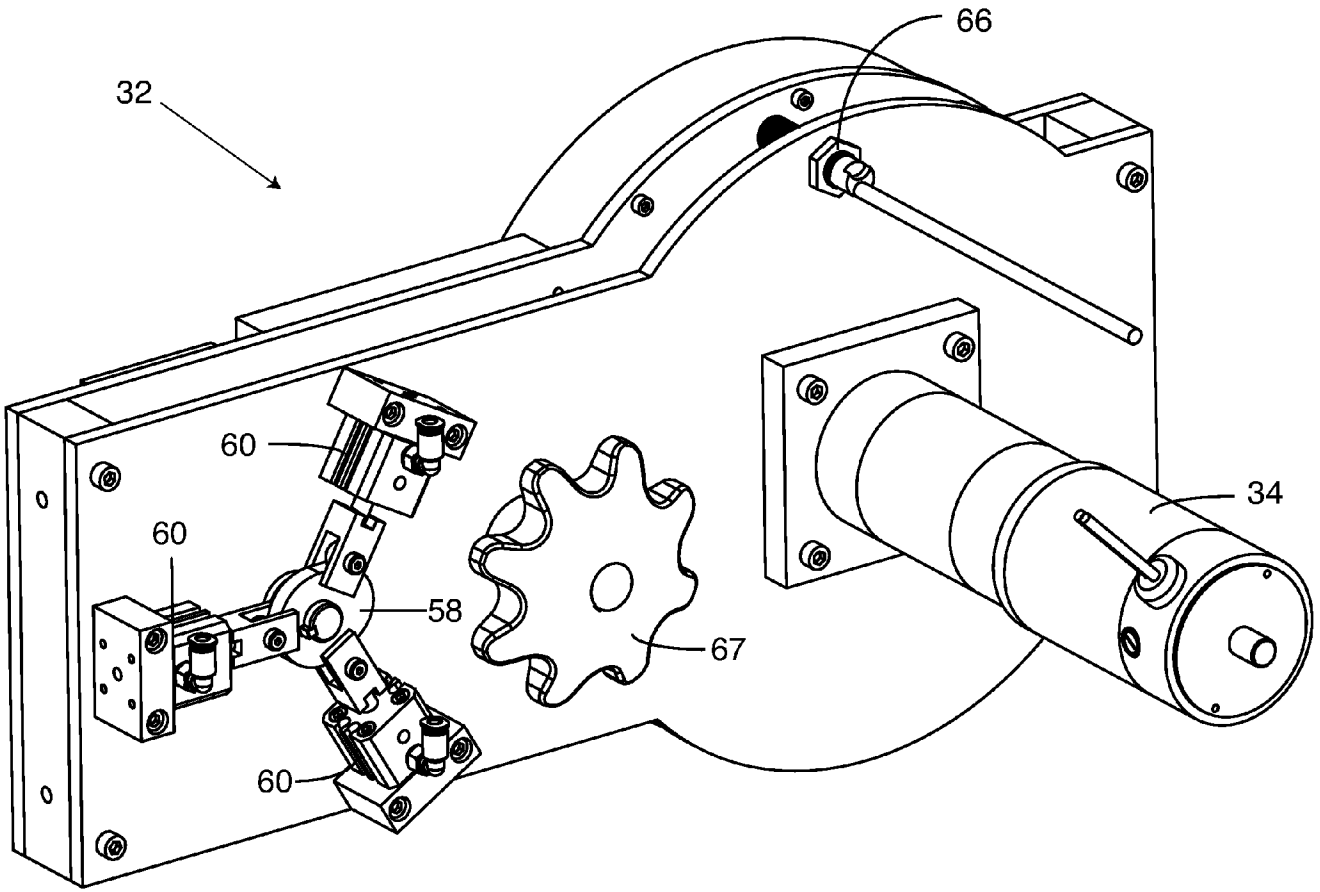
FIG. 3 is a perspective view from the back of the injection head of FIG. 2.

The heart of both variants of the apparatus is the injection head 32. FIGS. 2 and 3 show front and rear views of the injection head 32 respectively. The injection head 32 comprises three rotary mechanisms or wheels that are geared together and driven by a motor 34. The three wheels include a rotary feed mechanism such as selector wheel 36, a rotary sphere delivery mechanism such as transfer wheel 38, and a rotary injector mechanism such as needle rotor 40.

Unprimed incendiary spheres from the hopper 30 collect in a well 42 in front of the selector wheel 36, which is composed of two plates 44 and 46 separated by a gap. Due to the angle of the hopper 30 and the action of an agitator 48 provided on the outer surface of plate 44 and partially within the well 42, the spheres 31 in the hopper 30 populate and are captured in at least one second pocket such as pockets 50 defined in the selector wheel 36. In the illustrated embodiment, the selector wheel 36 has six pockets 50. The selector wheel 36 rotates counter clockwise when viewed from the front. The above described feed mechanism thus cooperates with the hopper to extract unprimed spheres from the hopper. It will thus be apparent to the skilled reader that other configurations of feed mechanisms may be used to deliver unprimed spheres to the rotary sphere delivery mechanism or transfer wheel 38.

The transfer wheel 38 is geared to the selector wheel 36 through a 2:1 reduction. The transfer wheel 38 has at least one pocket define therein such as pockets 52. In the illustrated embodiment, the transfer wheel 38 has three pockets 52 defined therein, or in other words half the number as defined in the selector wheel 36. The transfer wheel 38 rotates in a first direction such as clockwise direction. Each pocket 50 in the selector wheel 36 aligns with a pocket 52 in the transfer wheel 38 as both wheels rotate. Thus the selector wheel and the transfer wheel are synchronized, which in the illustrated embodiment is accomplished by the 2:1 gear reduction. A portion of the housing of the transfer wheel 38 extends between the two plates 44 and 46 of the selector wheel 36. As the wheels rotate, the spheres 31 are stripped out of the selector wheel pockets 50 and into the transfer wheel pockets 52 as the two pockets come into alignment. Not shown is a front cover which keeps the spheres in the transfer wheel 38.

The needle rotor 40 is geared to the transfer wheel 38 through a 1:1 connection, and it rotates in an opposing second direction such as counter clockwise. The needle rotor includes at least one injector needle such as needle 56, and in the illustrated embodiment there are three needles 56 in the rotor 40, each of which aligns with and invades a pocket 52 in the transfer wheel 38 as the rotor 40 and the transfer wheel 38 rotate. Accordingly, the needle rotor and the transfer wheel 38 are synchronized such that a needle 56 pierces an unprimed sphere within the pocket 52 as the pocket 52 and the needle 56 rotate past each other. As the transfer wheel 38 rotates, the needles 56 are forced into the spheres 31 which are captured in the pockets 52 of the transfer wheel 38 as each needle converges with each pocket as the needle rotor and transfer wheel rotate. Once the needle 56 is fully penetrated into a sphere 31, a cam 58 on the rear of the rotor 40 activates a glycol pump 60 to deliver a measured amount of glycol into the appropriate needle 56 through the glycol manifold 62. The pumps 60 are preferably constant volume pumps of the kind known in the art, for example as described in U.S. Pat. Nos. 8,776,693 and 8,316,750, which are incorporated herein by reference.

As the needle rotor 40 continues to rotate, the sphere 31 adheres to the injection needle 56 and is thus pulled out of the pocket 52 of the transfer wheel 38. After a fixed dwell angle, the sphere encounters a sphere expulsion mechanism such as the ramped portion or ramp 64 of the glycol manifold 62. Further rotation causes the ramp 64 on the manifold 62 to strip the sphere 31 from the needle 56, allowing the charged or primed sphere 31 to fall from the machine. A stripping mechanism such as fingers 68 are provided and cooperate with the transfer wheel 38 to clear a sphere, or debris in the event of a broken sphere, left in the pocket 52 after passing the ramp 64. In the illustrated embodiment, the transfer wheel 38 is comprised of two parallel disks (similar to the selector wheel 36), and the fingers 64 pass in between the plates so as to be able to dislodge any significant debris from the pocket 52 as it rotates past the fingers 64. However, it will thus be apparent to the skilled reader that other configurations of the rotary sphere delivery mechanism or rotary injector mechanism may be used in the present invention.

The geometry of the illustrated apparatus is such that when one needle 56 has just been stripped from a primed sphere 31, the next needle 56 has yet to pierce the next unprimed sphere 31. This allows the apparatus to be stopped at one of three points in the rotation without the risk of further ignition in the machine. A position sensor 66 that is operable to read the position of the selector wheel 36 is used to implement this function. This is an advantage over prior art aerial dispensers that rely on gates to block the flow of unprimed spheres into the injection area, and then must be continued to be run for several additional cycles in order to clear the unprimed spheres caught in the queue between the gates and the injectors.

The injection head 32 uses a motor 34 with an encoder to provide feedback to the controller. This allows for the speed of dispensing to be electronically controlled. It also allows for anti-jam software to be incorporated in the controller. The apparatus may be operated by a wired or wireless hand held control that provides as stop/run switch, speed control, and various LEDs connected to glycol and sphere level sensors, as are known in the art. A hand wheel 67 is provided on the rear of the injection head 32 that directly drives the transfer wheel 38 for manual operation to manually clear jammed spheres.

The hopper 30 preferably may include two level sensors 21, one positioned higher than the other, that are operable to sense the presence of unprimed spheres in the hopper 30 that are adjacent the sensors 21. When the level of spheres drops below the highest sensor, a caution indication (amber) may be indicated on the operator's hand control. When the level drops below the lower critical level, the machine may complete its current injection and then stop. The indicator on the operator's hand control may then change to red.

A similar set of high/low sensors may be installed in the reactant or glycol reservoir 22 with similar function of warning the operator when the glycol level reaches the upper sensor, and causing the apparatus finish it cycle and stop when the glycol level drops below the lower sensor, hence a critical level. Thus separate caution (amber) and critical (red) indicators may be provided on the operator's hand control.

Figure 4:
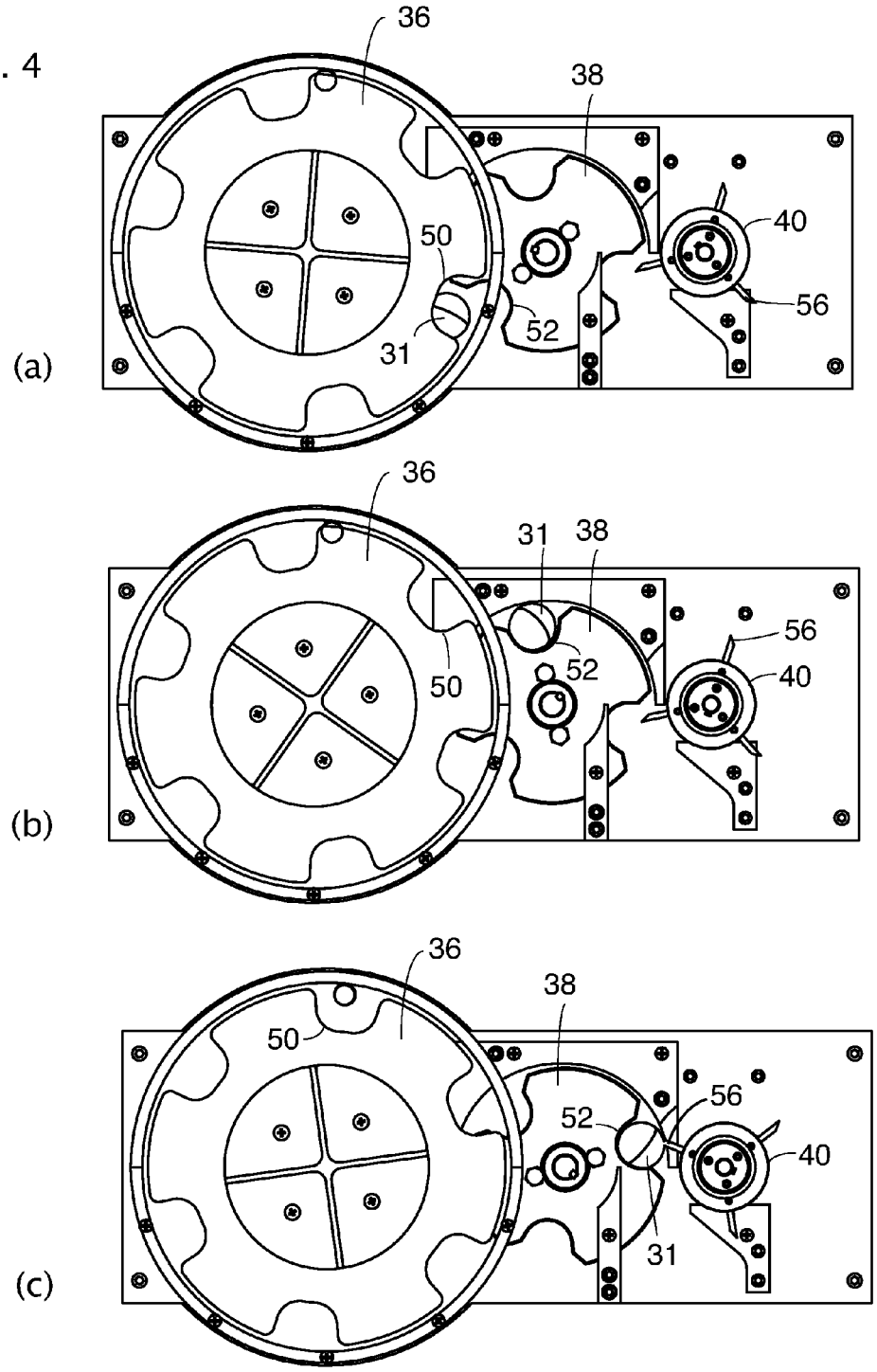
FIG. 4 is a series of schematic views (a)-(e) of the injection head of FIG. 2 showing the interaction of the three wheels at various relative angles of rotation.
Figure 4:
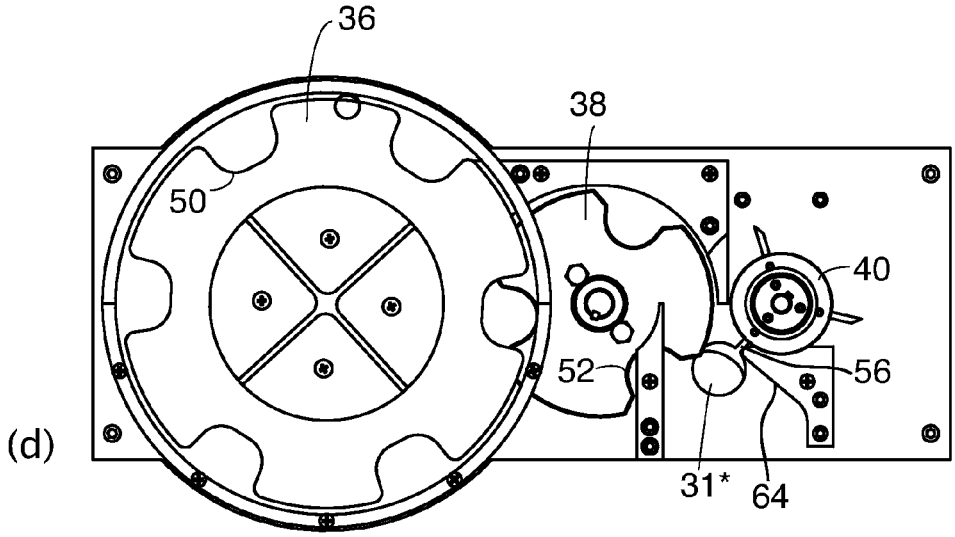
Figure 4:
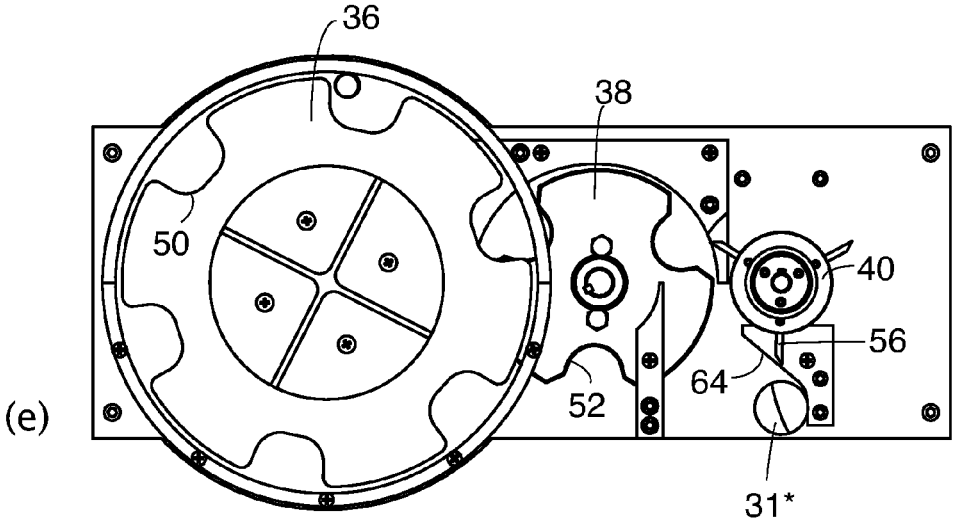

Referring to FIG. 4, an unprimed incendiary sphere 31 is shown in FIG. 4(*a*) received within pocket 50 of the selector wheel 36 after it had populated the pocket from the hopper 30. As the selector wheel 36 turns counter clockwise and the transfer wheel 38 turns clockwise, the pocket 50 aligns with pocket 52 on the transfer wheel 38, and the sphere 31 is stripped out of pocket 50 and into pocket 52 as shown in FIG. 4(*b*). As the transfer wheel 38 turns clockwise and the injection rotor 40 turns counter clockwise, the injection needle 56 aligns with the pocket 52, as shown in FIG. 4(*c*), and the needle 56 pierces the unprimed sphere 31. At the same time, the pump cam 58 engages glycol pump 60 and causes it to dispense a metered amount of glycol into the sphere to cause an exothermic chemical reaction to start and thereby prime the sphere. As both the transfer wheel 38 and the injection rotor 40 continue to turn, the needle 56 strips the primed sphere 31* out of the pocket 52 as shown in FIG. 4(*d*), and then against ramp 64, which in turn strips the primed sphere 31* from the needle 56 as shown in FIG. 4(*e*). The primed incendiary sphere 31* is then able to fall away from the apparatus and onto the forest or vegetation below.

It is understood that the embodiments described and illustrated herein are merely illustrative of embodiments of the present invention. Other embodiments that would occur to those skilled in the art are contemplated within the scope of the present invention. The invention includes variants not described or illustrated herein in detail. Thus, the embodiments described and illustrated herein should not be considered to limit the invention as construed in accordance with the accompanying claims.

What is claimed is:

1. An apparatus for dispensing incendiary spheres comprising:

a. a hopper operable to store discrete unitary unprimed spheres;

b. a feed mechanism cooperating with the hopper to extract unprimed spheres from the hopper;

c. a rotary sphere delivery mechanism rotating in a first direction and having at least one pocket defined therein, the at least one pocket being adapted to capture a sphere, wherein the feed mechanism cooperates with the rotary sphere delivery mechanism to load an unprimed sphere into the at least one pocket;

d. a rotary injector mechanism rotating in an opposing second direction and having at least one injector needle, wherein the rotary injector mechanism and the rotary sphere delivery mechanism are synchronized such that the at least one injector needle pierces an unprimed sphere within the at least one pocket as the at least one pocket and the at least one injector needle rotate past each other;

e. a source of reactant in fluid communication with the at least one injector needle, wherein the rotary injector mechanism delivers an amount of reactant to the at least one injector upon the at least one injector piercing the sphere to start a delayed exothermic reaction within the sphere thereby priming the sphere; and f. a motor to drive the rotary sphere delivery mechanism and the rotary injector mechanism.

2. The apparatus as claimed in claim 1 further comprising a sphere expulsion mechanism operable to expel the primed sphere from the apparatus so that the primed sphere may fall away from the apparatus.

3. The apparatus as claimed in claim 2 wherein the at least one injector needle is operable to withdraw the primed sphere from the at least one pocket as the at least one pocket and the at least one injector needle rotate away from each other, and the sphere expulsion mechanism comprises a ramp surface against which the primed sphere abuts after withdrawal from the at least one pocket, the ramp surface being configured to cause a release of the primed sphere from the at least one injector needle.

4. The apparatus as claimed in claim 2 further comprising a stripping mechanism cooperating with the rotary sphere delivery mechanism to clear a sphere, or debris in the event of a broken sphere, left in the at least one pocket after the sphere expulsion mechanism.

5. The apparatus as claimed in claim 1 wherein the feed mechanism comprises a rotary feed mechanism defining at least one second pocket adapted to capture a sphere from the hopper, wherein the rotary feed mechanism is synchronized with the rotary sphere delivery mechanism such that the at least one second pocket aligns with the at least one pocket on the rotary sphere delivery mechanism to deliver its sphere to the at least one pocket.

6. The apparatus as claimed in claim 5 wherein the motor drives the rotary feed mechanism, and wherein the rotary sphere delivery mechanism and the rotary injector mechanism are directly or indirectly geared to the rotary feed mechanism.

7. The apparatus as claimed in claim 6 further including a position sensor operable to provide information on the spatial position of any one or more of the at least one pocket, the at least one injector needle, and the at least one second pocket.

8. The apparatus as claimed in claim 7 further including a controller operable use the spatial position provide by the position sensor to stop the motor just after release of the primed sphere from the at least one pocket but before a next sphere is primed by the at least one injector needle.

9. The apparatus as claimed in claim 1 wherein the rotary injector mechanism includes a constant volume pump that is activated upon the at least one injector needle piercing the sphere to deliver a measured volume of reactant to the sphere.

10. The apparatus as claimed in claim 1 further comprising a support upon which the other structures are mounted, wherein the support includes suspension members to enable the apparatus to being suspended below an aircraft.

11. The apparatus as claimed in claim 1 further comprising a support upon which the other structures are mounted, wherein the support is adapted to being mounted in an aircraft in a manner that the primed spheres fall outside of the aircraft.

* * * * *